United States Patent [19]

Pfeiffer et al.

[11] 4,102,705

[45] Jul. 25, 1978

[54] METHOD FOR REMOVING ACIDS FROM AN AQUEOUS ACID-CONTAINING XYLOSE SOLUTION

[75] Inventors: Hans Jorg Pfeiffer; Keller René, both of Winterthur; Frank Erich, Raeterschen, all of Switzerland

[73] Assignee: Sulzer Brothers Ltd., Winterthur, Switzerland

[21] Appl. No.: 696,855

[22] Filed: Jun. 16, 1976

[30] Foreign Application Priority Data

Jul. 2, 1975 [CH] Switzerland ..... 8594/75

[51] Int. Cl.[2] ..... C13K 1/02; C13K 13/00

[52] U.S. Cl. ..... 127/37; 127/46 A; 127/9

[58] Field of Search ..... 127/9, 37, 46 A; 210/264, 37 R

[56] References Cited

U.S. PATENT DOCUMENTS

| | | | |
|---|---|---|---|
| 2,198,785 | 4/1940 | Mohr et al. | 127/37 |
| 2,422,821 | 6/1947 | Bhoota | 210/264 X |
| 2,464,311 | 3/1949 | Hiatt et al. | 210/264 X |
| 2,510,980 | 6/1950 | Jacobs et al. | 127/46 A |
| 2,688,572 | 9/1954 | Warshaw | 127/46 A |
| 3,406,113 | 10/1968 | Anderson | 210/37 R |
| 3,558,725 | 1/1971 | Kohno et al. | 127/37 X |
| 3,785,863 | 1/1974 | Deviller et al. | 127/9 |
| 3,970,712 | 7/1976 | Friese | 127/37 X |
| 3,990,904 | 11/1976 | Friese et al. | 127/37 |

*Primary Examiner*—Morris O. Wolk
*Assistant Examiner*—Michael S. Marcus
*Attorney, Agent, or Firm*—Kenyon and Kenyon, Reilly, Carr and Chapin

[57] ABSTRACT

The aqueous acid-containing xylose solution is first passed through an ion exchanger to remove the strong acid which was added to the raw material in the xylane hydrolysis and xylose extraction system and then subjected to evaporation in an evaporator. The evaporated water, acetic acid and formic acid of the solution is then condensed and is partly re-cycled and partly subjected to recovery processes. The concentrated xylose solution in the evaporator is then passed through a second ion exchanger to remove any traces of acetic acid or formic acid.

4 Claims, 2 Drawing Figures

Figure 1:
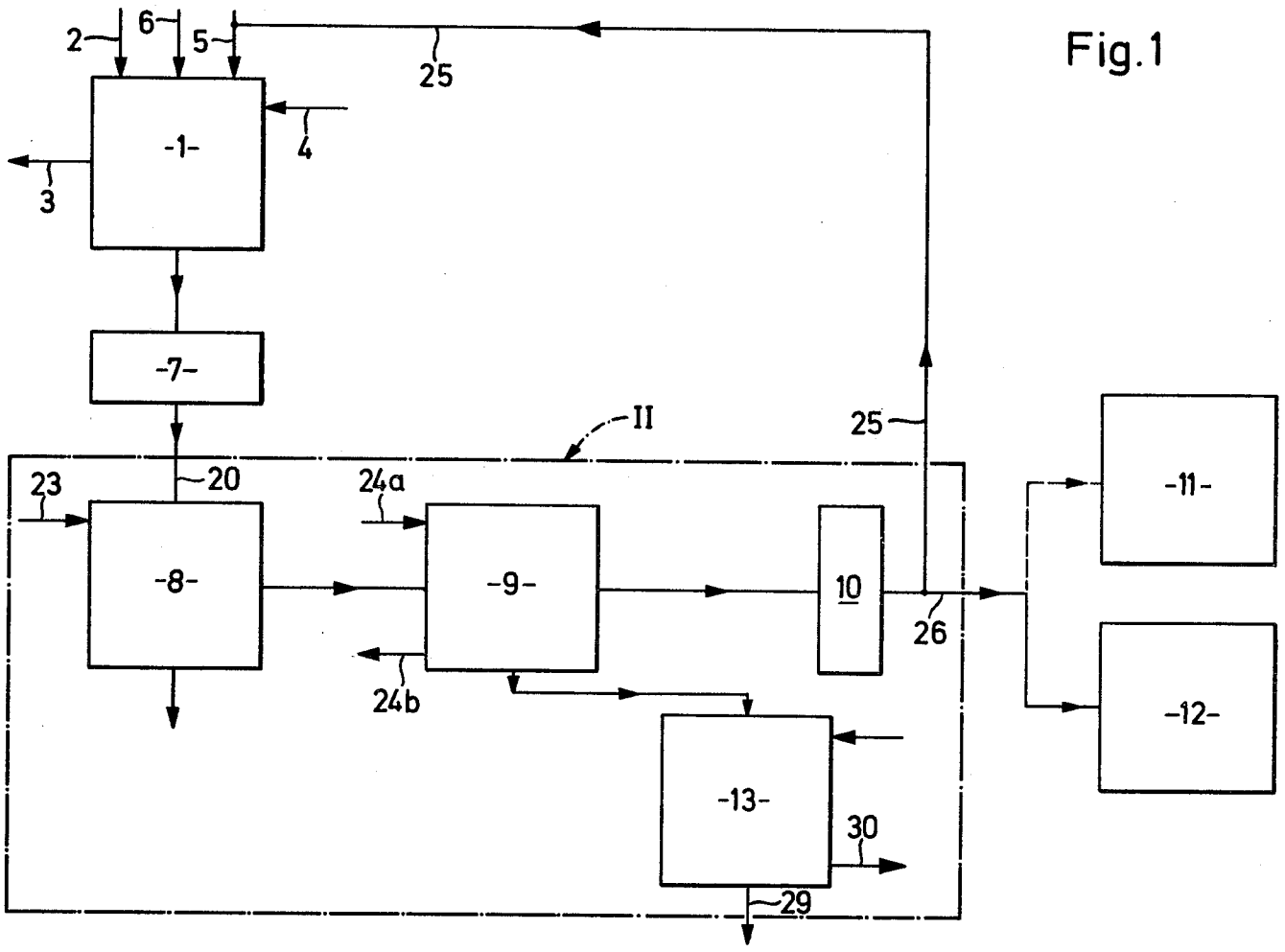

-1-
-7-
-8-
-9-
-11-
-12-
-13-
2
3
4
5
6
10
11
20
23
24a
24b
25
25
26
29
30

METHOD FOR REMOVING ACIDS FROM AN AQUEOUS ACID-CONTAINING XYLOSE SOLUTION

This invention relates to a method and apparatus for removing acids from an aqueous acid-containing xylose solution. More particularly, this invention relates to a method and apparatus for removing strong acid externally supplied to a xylane hydrolysis and xylose extraction system and also for removing acetic and formic acid produced during the xylane hydrolysis from the resulting aqueous xylose solution containing the last-mentioned acids.

As is known, a xylose solution can be obtained from raw materials containing xylane by hydrolyzing the xylane by the action of acid solutions and by extracting the resulting xylose with water. The impregnating agent used is frequently a strong acid. As is also known, the strength of an acid depends on the degree of dissociation, i.e. the content of hydrogen ions with mineral acids such as hydrochloric, sulphuric and nitric acids being among the strongest acids.

When a xylose solution is manufactured, additional products, particularly acetic acid and formic acid, are produced from the xylane-containing raw materials during the process. Generally, the quantity of formic acid formed is smaller than the quantity of acetic acid.

In order to remove these acids, i.e. the strong acid introduced for hydrolysis, the acetic acid and the formic acid, use has been made of ion exchangers. However, ion exchangers are expensive devices and the ion-exchange process has harmful effects on the environment, since ion exchangers are regenerated with an alkali and the salts produced by neutralization remain in the waste water.

Accordingly, it is an object of the invention to improve the manner of removing acids from a xylose solution.

It is another object of the invention to provide a very economic method of removing harmful components, particularly hydrochloric or sulphuric or acetic or formic acid from a generated aqueous xylose solution before further processing.

It is another object of the invention to reduce the impact of xylose production on the environment.

It is another object of the invention to reduce the amount of pure water required for the hydrolysis and extraction processing of xylane containing raw materials to produce xylose.

Briefly, the invention provides a method and apparatus for removing acid, including an externally supplied strong acid, from an aqueous acid-containing xylose solution generated in a xylane hydrolysis and xylose extraction system.

The method is divided into a number of different steps in order to sequentially remove the various acids. First, the solution is subjected to an ion-exchange to remove the externally supplied strong acid. The removal of this strong corrosive acid avoids damage and possible destruction of the downstream components. Next, the remaining xylose solution is heated to evaporate the water and the weaker acids, i.e. acetic and formic acids from the solution while concentrating the solution. Finally, the concentrated xylose solution is subjected to an ion-exchange to remove any traces of the weaker acids, i.e. the acetic or formic acids, and to produce an acid-free concentrated xylose solution.

According to an advantageous feature of the invention, the water and acetic and formic acids are condensed to liquid form and at least a part of the liquified water and acetic and formic acid is returned to the hydrolysis and extraction system. As a result, a corresponding reduction can be made in the amount of pure water added to the hydrolysis and extraction system. There is also an increase in the concentration of the evaporated solution, thus reducing the cost of further processing. In a process of this kind, for example, pure acetic or formic acid can be obtained by liquid/liquid extraction or pure water can be recovered in a biological decomposition process.

The apparatus which is used in combination with the hydrolysis and extraction system includes a first pair of ion exchangers connected in parallel, an evaporator, a condenser and a second pair of ion exchangers connected in parallel.

The first pair of ion exchangers is selectively connected via valves to the hydrolysis and extraction system to alternately receive a flow of acid containing xylose solution from the system for removal of the strong acid from the solution. These ion exchangers are used alternately for extraction and regeneration.

The evaporator is selectively connected to each of the ion exchangers of the first pair, via a line, to alternately receive a flow of acid-depleted solution from each for evaporating the water, acetic acid and formic acid from the solution. For this purpose, the evaporator includes a suitable heating means to charge the evaporator with a heating medium.

The condenser is connected via a line to the evaporator to receive and liquify a flow of vaporized water, acetic acid and formic acid from the evaporator.

The second pair of ion exchangers are selectively connected to the evaporator via a line to alternately receive a flow of concentrated xylose solution from the evaporator for removal of any traces of acetic and formic acid. These ion exchangers, as above, are used alternately for extraction and regeneration.

By virtue of the invention, only relatively small devices are required, since a much smaller amount of ion exchangers are used than for the hydrolyzed material (xylose solution + strong acid + acetic and formic acid) originating from the hydrolysis and extraction system. This correspondingly reduces the cost, and only very small amounts of salts are transferred to the waste water during regeneration.

Figure 2:
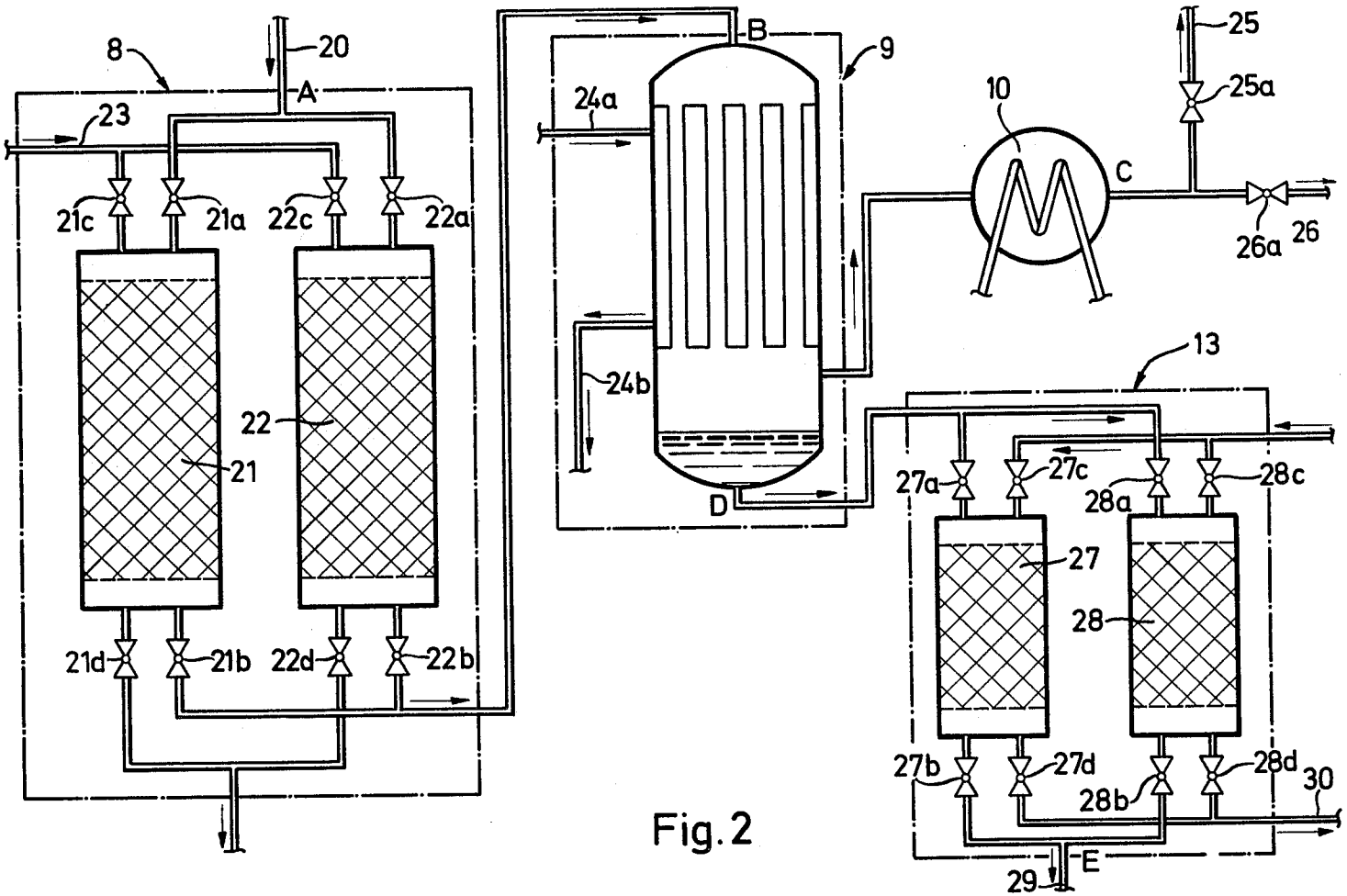

These and other objects and advantages of the invention will become more apparent from the following detailed description and appended claims taken in conjunction with the accompanying drawings in which:

FIG. 1 diagrammatically illustrates an installation comprising a xylane hydrolysis and xylose extraction system, a system for removing acids in accordance with the invention and a system for further processing the acetic and formic acid solution; and FIG. 2 illustrates a detailed view of an embodiment of a system according to the invention for removing acids from the xylose solution.

Referring to FIG. 1, the xylane hydrolysis and xylose extraction system 1 for obtaining a xylose solution is connected to a line 2 for supplying a raw material containing xylane (e.g. beech wood), a line 3 for removing the raw material after treatment, a steam supply line 4, a pure-water supply line 5 and a supply line 6 for a strong acid, more particularly hydrochloric acid. An aqueous acid-containing xylose solution is obtained in the system 1.

A filter 7 is connected via a suitable means to the system 1 to receive the acid-containing xylose solution and to filter out suspended matter in known manner.

A system for removing acids from the aqueous acid-containing xylose solution includes an ion-exchanger system 8, an evaporator 9, a condenser 10 and a second ion-exchange system 13.

The ion exchanger system 8 removes the stronger acid from the xylose solution while the evaporator 9 serves to evaporate and separate out water and the weaker acetic and formic acids. The second ion-exchange system 13 serves to remove any remaining traces of acetic or formic acid from the concentrated xylose solution formed in the evaporator 9. The condenser 10 functions to liquify the evaporated water, acetic acid and formic acid either for re-cycling of at least a part to the hydrolysis and extraction system 1 and for delivery to a system for further processing of the acetic and formic acid. This latter system may include a liquid/liquid extraction system 11 for obtaining pure acetic and formic acid or a known biological decomposition system 12 in which pure water is recovered.

Referring to FIG. 2, the ion exchanger system 8 includes a pair of parallel ion exchangers 21, 22 which are selectively connected via a line 20 and valves *21a, 22a* to the hydrolysis and extraction system 1 and filter 7 to alternately receive a flow of acid-containing solution. Each exchanger 21, 22 is packed, for example with macroporous synthetic resin of a type suitable for removing strong acids such as hydrochloric acid from the solution. Control valves *21b, 22b* are connected to the outlets of the ion exchangers 21, 22 for purposes as described below. In addition, a line 23 is connected via valves *21c, 22c* to the exchangers 21, 22 to deliver either pure water or an aqueous alkali. Suitable outlets having valves *21d, 22d* therein are located in each exchanger 21, 22 for purposes as described below.

The exchangers 21, 22 are used alternately for extraction and regeneration. To this end, during one period, the hydrolyzed material is fed to the ion exchanger 21 through line 20 when the valves *21a* and *21b* are open (valve *21c* and *21d* and valve *22a* to the other exchanger 22 are closed). As soon as the ion exchanger 21 is charged with hydrochloric acid, the valves *21a, 21b* are closed and valves *21c* and *21d* are opened, so that the xylose solution can be emptied out, by supplying pure water to the ion exchanger 21 through the line 23. At this time, the valves *22a* and *22b* to the other exchanger 21 are opened while the valves *22c, 22d* are closed. The regeneration process for the ion exchanger 21 is then started, by introducing an aqueous alkali (e.g. caustic soda solution) through the line 23 into the exchanger 21. The salt solution produced by neutralization of the ion-exchanger bed is then transferred from the ion exchanger 21 to a waste-water vessel (not shown). Operation of the other exchanger 22 is of similar nature. Thus, by controlling the operation of the various valves, one exchanger is used to extract acid, while the other exchanger is regenerated.

Acetic and formic acid and water are removed from the hydrolyzed material in an evaporator 9, which is supplied with a heating medium (e.g. steam) which enters through a line *24a* of a heating means and leaves the evaporator 9 in condensed form through a line *24b*. The vaporized water, acetic acid and formic acid passes via a line and is liquified in the condenser 10 and at least a part is returned through a line 25 to the hydrolysis and extraction system 1, whereas the result is conveyed through a line 26 and introduced either into the liquid/-liquid extraction system 11 (FIG. 1) or the biological decomposition system 12 (FIG. 1). As shown, valves *25a* and *26a* are used to adjust the quantities delivered via the lines 25, 26.

The second ion exchange system 13 is similar in construction to the ion exchange system 8 and includes a pair of parallel ion exchangers 27, 28 selectively connected via a line and valves *27a, 28a* to the evaporator 9. In addition, a line is connected over valves *27c, 28c* to the exchangers 27, 28 to deliver either pure water or aqueous alkali. Various valves *27b, 28b, 27d, 28d* also connect with outlet lines 29, 30 respectively to take off either an acid-free xylose solution or a salt solution.

The second ion exchange system 13 serves to remove any remaining traces of acetic or formic acid in the concentrated xylose solution from the evaporator 9, and as system 8, is used alternately for extraction and regeneration. This system 13 operates in the same manner as system 8 and to avoid repetition will not be described in detail.

After the acids have been removed from the xylose concentrate, the concentrate is conveyed through the line 29 for further treatment, whereas the salt solution is transferred to a waste-water vessel (not shown) through the line 30.

The following is a numerical example relating to the embodiment in the drawings. The numerical values relate to the quantities at places A – E in FIG. 2.

| NUMERICAL EXAMPLE | |
|---|---|
| A. Hydrolyzed Material containing | 40 kg hydrochloric acid<br>90 kg organic acids<br>(acetic and formic acid) |
| B. Hydrolyzed Material containing | 90 kg organic acids |
| C. Condensate containing | 81 kg organic acids |
| D. Xylose Concentrate containing | 9 kg organic acids |
| E. Xylose Concentrate | free from acids |

What is claimed is:

1. A method of producing an acid-free xylose solution comprising the steps of hydrolyzing a raw material containing xylane with a strong acid to obtain an aqueous acid-containing xylose solution;

subjecting the solution to an ion-exchange to remove the strong acid;

thereafter heating the remaining xylose solution to evaporate water, acetic acid and formic acid therefrom while concentrating the xylose solution; and subjecting the concentrated xylose solution to an ion-exchange to remove any traces of acetic acid and formic acid from the concentrated xylose solution and to produce an acid-free concentrated xylose solution.

2. A method as set forth in claim 1 which further comprises the step of condensing the vaporized water, acetic acid and formic acid to liquified form for recycling at least a part of the liquified water, acetic acid and formic acid.

3. A method for removing acid including an externally supplied strong acid from an aqueous acid-containing xylose solution generated in a xylane hydrolysis and xylose extraction system comprising the steps of subjecting the solution to an ion-exchange to remove the externally supplied strong acid;

thereafter heating the remaining xylose solution to evaporate water, acetic acid and formic acid therefrom while concentrating the xylose solution, condensing the vaporized water, acetic acid and formic acid to liquified form, and subjecting the concentrated xylose solution to an ion-exchange to remove any traces of acetic acid and formic acid from the concentrated xylose solution and to produce an acid-free concentrated xylose solution.

4. A method as set forth in claim 3 which further comprises the step of re-cycling at least a part of the liquified water, acetic acid and formic acid to the hydrolysis and extraction system.

* * * * *